US005304109A

United States Patent [19]

Shockley

[11] Patent Number: 5,304,109

[45] Date of Patent: Apr. 19, 1994

[54] INFLATABLE SUPPORT

[76] Inventor: Ronnie W. Shockley, 8715 E. 21st St., Tucson, Ariz. 85710

[21] Appl. No.: 7,784

[22] Filed: Jan. 22, 1993

[51] Int. Cl.[5] ..... A63B 21/00

[52] U.S. Cl. ..... 482/142; 482/104; 482/908; 606/240; 602/13; 602/19; 5/456

[58] Field of Search ..... 482/105, 104, 142, 79; 602/13, 17, 18, 19; 5/456, 454, 652; 297/264.4, 264.5; 417/533

[56] References Cited

U.S. PATENT DOCUMENTS

| | | | |
|---|---|---|---|
| 3,612,731 | 10/1971 | Tanemoto | 417/533 |
| 4,190,286 | 2/1980 | Bentley | 297/284.5 X |
| 4,405,129 | 9/1983 | Stuckey | 482/79 X |
| 4,474,370 | 10/1984 | Oman | 482/104 |
| 4,597,386 | 7/1986 | Goldstein | 602/19 |
| 4,622,957 | 11/1986 | Curlee | 602/13 |
| 4,669,455 | 6/1987 | Bellati | 602/13 |
| 4,805,603 | 2/1989 | Cumberland | 602/13 |

FOREIGN PATENT DOCUMENTS

| | | | |
|---|---|---|---|
| 128534 | 12/1984 | European Pat. Off. | 297/284.5 |

*Primary Examiner*—Richard J. Apley
*Assistant Examiner*—Beverly A. Meindl
*Attorney, Agent, or Firm*—S. Michael Bender

[57] ABSTRACT

An inflatable flexible bladder is mounted on the surface of a weightlifter's bench to provide support to the spinal region. A pressure device activatable by the hand or foot of the weightlifter is employed to provide desired supporting internal pressure to the bladder. In an alternative embodiment, the inflatable bladder is mounted on an axially traversing carriage so that its longitudinal position on the weightlifting bench may be adjusted to comfortably fit weightlifters of varying size. A locking assembly is provided to fix the carriage in place after adjustment.

4 Claims, 4 Drawing Sheets

FIG 3
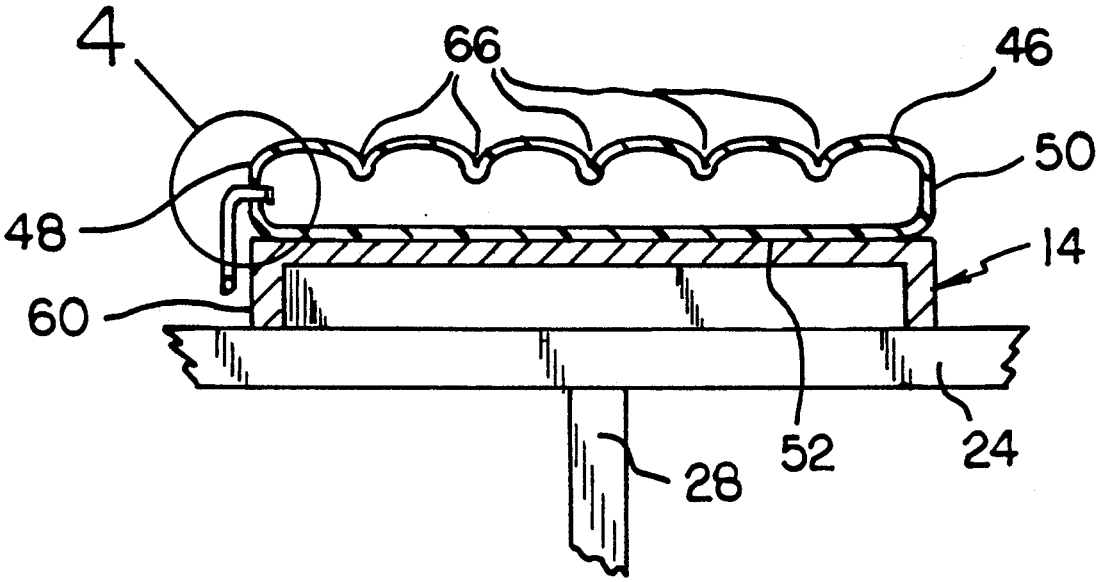
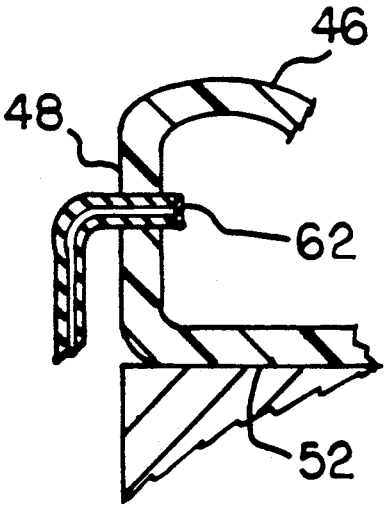
FIG 4
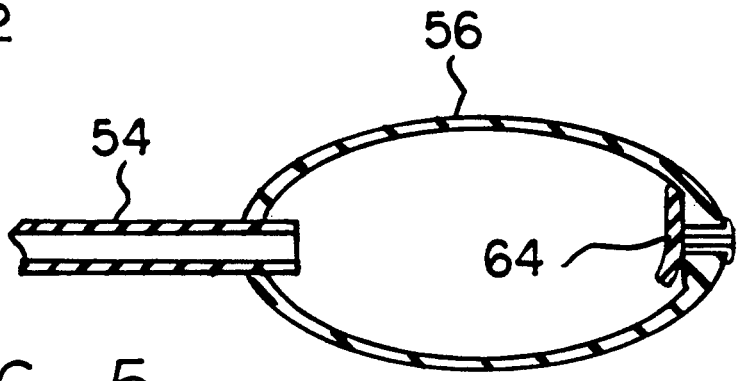
FIG 5

FIG 6
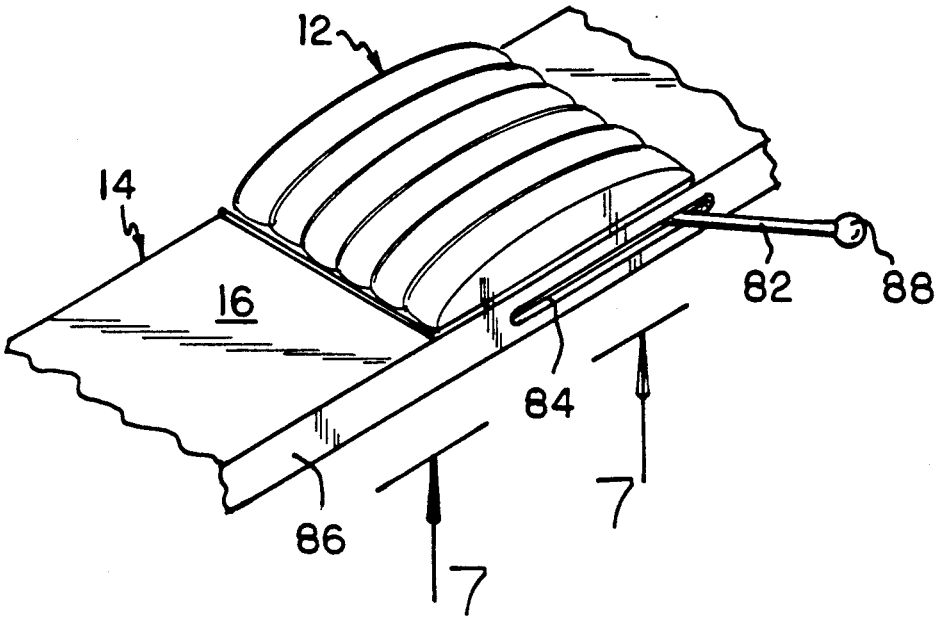
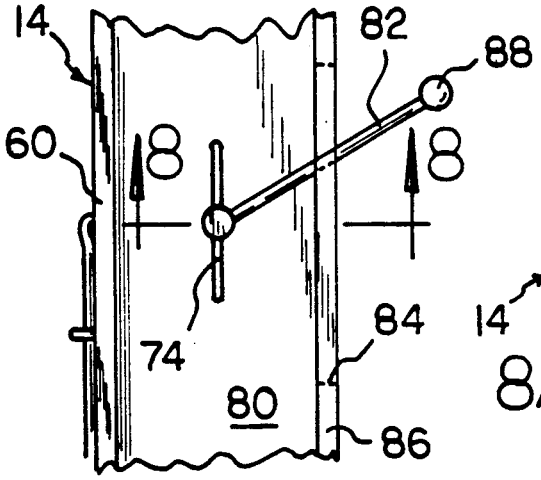
FIG 7
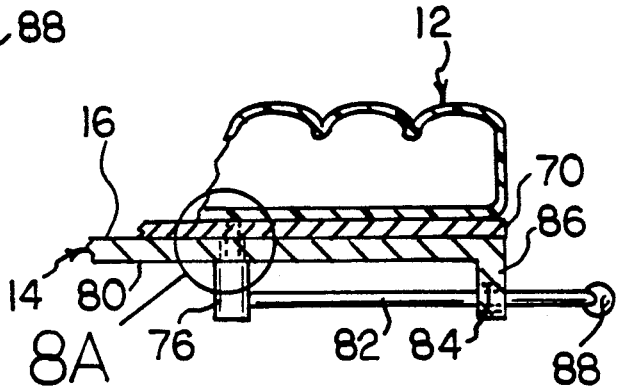
FIG 8
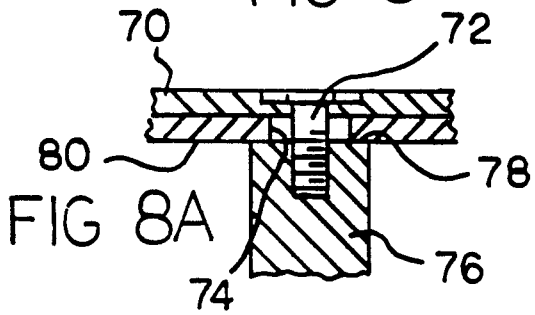
FIG 8A

INFLATABLE SUPPORT

BACKGROUND OF THE INVENTION

1. Field of the Invention

The present invention relates generally to inflatable bladders, and more particularly, to an inflatable bladder for use on a weightlifter's bench especially adapted to effect to afford adequate support to the weightlifter's lumbar spine region during lifting exercises in the supine position.

2. Description of the Prior Art

Devices for providing increased spinal support for weightlifters generally are known. For example, U.S. Pat. No. 4,641,837 shows a bench having a hinged section which may be locked into position at an angle relative to a fixed seat section. The angular orientation of the hinged section serves as an adjustable back rest for the weightlifter. Similarly, U.S. Pat. Nos. 4,905,993 and 4,968,027 disclose belt constructions which may be worn by a weightlifter and which are adapted to provide support to the lower back or the lumbar spinal region via use of specially shaped and moldable-mass midsections on each belt, respectively. Finally, U.S. Pat. Nos. 4,953,858 and 5,007,633 illustrate benches or tables having pads deployable thereon for providing support to the lumbar and cervical regions of a weightlifter's spine.

None of the foregoing prior art patents however, teaches the provision of a relatively simple, cost effective supporting device which may be adjusted (i.e. customized) to provide optimum support and comfort to the weightlifter's spine when the latter is in the supine position.

The foregoing disadvantages are overcome by the unique Inflatable support of the present invention as will be made apparent from the following description thereof. Other advantages of the present invention over the prior art also will be rendered evident.

SUMMARY OF THE INVENTION

To achieve the foregoing and other advantages, the present invention, briefly described, provides an inflatable flexible bladder mounted on the surface of a weightlifter's bench to provide support to the spinal region. A pressure device activatable by the hand or foot of the weightlifter is employed to provide desired supporting internal pressure to the bladder. In an alternative embodiment, the inflatable bladder is mounted on an axially traversing carriage so that its longitudinal position on the weightlifting bench may be adjusted to comfortably fit weightlifters of varying size. A locking assembly is provided to fix the carriage in place after adjustment.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining several preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved inflatable support which has all of the advantages of the prior art and none of the disadvantages.

It is another object of the present invention to provide a new an improved inflatable support which may be easily and efficiently manufactured and marketed.

It is a further objective of the present invention to provide a new and improved inflatable support which is of durable and reliable construction.

An even further object of the present invention is to provide a new and improved inflatable support which is susceptible of a low cost of manufacture with regard to both materials and labor, and which accordingly is then susceptible of low prices of sale to the consuming public, thereby making such inflatable support available to the buying public.

Still yet a further object of the present invention is to provide a new and improved inflatable support adapted to provide adjustable pressurized support to the back and spinal regions of a weightlifter in the supine position.

It is still a further object of the present invention is to provide a new and improved inflatable support mounted on a carriage movable on a table or other horizontal surface.

Still a further object of the present invention is to provide a new and improved inflatable support having pressurizing means adapted to be activated by a person in the supine position using his hand or foot.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed thereof. Such description makes reference to the annexed drawings wherein:

FIG. 3 is a cross-sectional view of the inflatable support of FIG. 2 taken along line 3—3 thereof.

FIG. 4 is a perspective view in elevation of a portion of the first preferred embodiment of the invention.

FIG. 5 is a partial cross-sectional view in elevation of the pressure bulb of the first preferred embodiment of the invention taken along 5—5 of FIG. 2.

FIG. 6 is an enlarged perspective view showing a second preferred embodiment of the inflatable support of the invention.

FIG. 7 is a bottom view of a portion of the table employed with the second preferred embodiment of the invention.

FIG. 8 is a cross-sectional view in elevation taken along line 8—8 of FIG. 7.

FIG. 8A is an enlarged detail of a portion of the invention shown in FIG. 8.

DESCRIPTION OF THE PREFERRED EMBODIMENT

Figure 1:
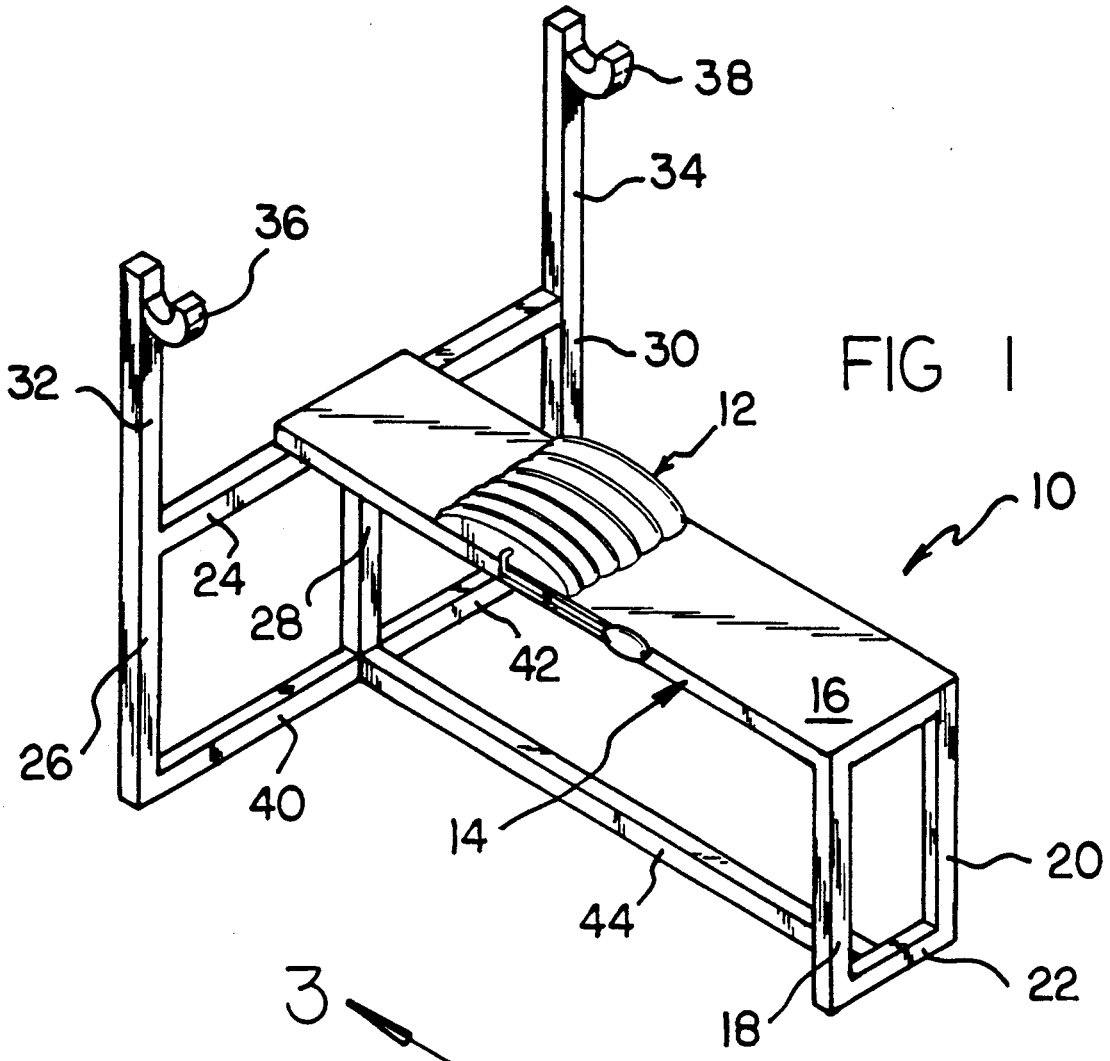
FIG. 1 is a perspective view showing the first preferred embodiment of the inflatable support of the invention positioned on a weightlifting table.

With reference now to the drawings, a new and improved inflatable support embodying the principles and concepts of the present invention will be described.

Turning initially to FIGS. 1-5, there is shown a first exemplary embodiment of the inflatable support of the invention generally designated by reference numeral 10. In its preferred form, inflatable support 10 comprises a flexible, inflatable bladder generally designated by reference numeral 12 mounted upon a weightlifting bench or table generally designated by reference numeral 14. More specifically, bladder 12 is mounted on the flat, upwardly facing, substantially horizontal surface 16 of table 14 intermedially of the ends thereof.

Table 14 is supported at one end by a pair of vertical legs 18, 20 and a cross bar 22 extending transversely and parallel to the short side of the table's one end, and at its other end by a transverse cross bar 24 which, in turn, is supported on three vertical, laterally spaced legs 26, 28 and 30 substantially as shown. Extending upwardly from legs 26 and 30 are a pair of extensions 32 and 34 each of which has a corresponding arcuate support member 36 and 38 extending longitudinally with respect to the long axis of table 14 toward inflatable bladder 12. As is well known in the weightlifting bench art, support members 36, 38 are designed to support a barbell (not shown) parallel to the other end of table 14 and within reach of the hands and arms of a lifter lying on the table in a supine position. A pair of cross bars 40, 42 extend respectively between the bottoms of legs 26, 28 and 28, 30, whereas a longitudinal cross bar 44 extends between the bottom of leg 28 and the center of cross bar 22.

Figure 2:
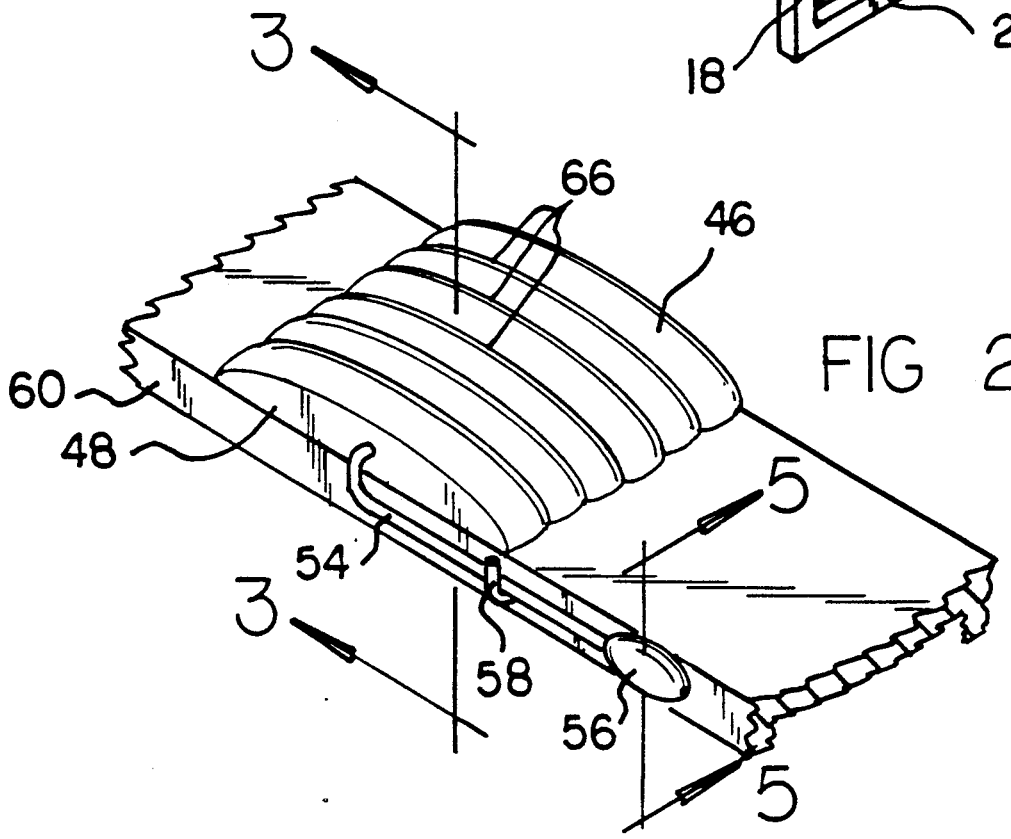
FIG. 2 is an enlarged perspective view showing the first preferred embodiment of the inflatable support of the invention.

In accordance with the first preferred embodiment of the invention, inflatable bladder 12 is placed in position on surface 16 of table so as to provide pressurized support in the lumbar spinal region of a lifter on the table in a supine position. In this regard, and as best seen in FIGS. 2 and 3, inflatable bladder has an arcuate or cylindrically shaped top panel 46, a pair of opposed substantially flat side panels 48, 50, and a flat bottom panel 52. Extending through side panel and into the hollow interior of inflatable bladder 12 is a flexible tube or supply pipe 54 for conveying air under pressure. The other or remote end of pipe 54 as suitably connected to a flexible squeeze bulb 56 which when squeezed by the hand of a lifter is adapted to force air under pressure into the interior of inflatable bladder 12 to thereby pressurize same and increase the cushioning support afforded by the bladder as desired by the lifter. A hook 58 extending from sidewall 60 of table 14 provides support for pipe 54 which latter extends along sidewall 60 parallel thereto to a position where flexible squeeze bulb is easily grasped by the right hand of a lifter lying in a supine position on surface 16 of the table with the lumbar region of the lifter's spine and or back resting on panel 46 of bladder 12. It will be appreciated that the bladder also may include a suitable pressure relief valve (not shown) in the event it is desired to reduce the internal air pressure therein as will be apparent to those of ordinary skill.

Turning to FIGS. 3 through 5, the end of pipe 54 extending into the hollow interior of inflatable bladder 12 is terminated by a one-way flapper valve 62. Similarly, the other or opposite end of pipe 54 extends into the hollow interior of squeeze bulb 56 and the distal end of the bulb includes a one-way flapper valve 64. Hence, when bulb 56 is compressed valve 54 is opened and air from the bulb is transferred to the interior of bladder 12. Subsequently, when flexible squeeze bulb 56 is released it will return to its original non-squeezed configuration thereby creating a low air pressure zone inside the bulb resulting in an inrush of air through flapper valve 64.

It will be noted that in its preferred form, top panel 46 of bladder 12 includes a series of spaced, parallel longitudinally extending grooves each designated by reference numeral 66 which grooves provide passages for air thereby reducing if not eliminating entirely the tendency of perspiration collecting between an otherwise flat panel and the back of the lifter working out on bench 14.

In the preferred embodiment of FIGS. 1 through 5, the inflatable bladder 12 may simply be positioned on surface 16 of table 14 prior to a lifter mounting the table in a supine position with his back resting on the bladder's top panel. Alternatively, fastening means (not shown) may be provided between the flat bottom panel of the bladder and the surface 16 to fix the bladder in a predetermined position on the table. Such fastening means may include, by way of example, a suitable adhesive, a suitable belt and belt buckle arrangement, cooperating snap-fasteners, or mating elements of hook and loop fabric fastener material such as sold under the Registered Trademark VELCRO.

A more advantageous arrangement would permit sliding longitudinal adjustment of bladder 12 on the top surface 16 of table 14 especially (but not necessarily) after the lifter is positioned on the table in a supine manner and before lifting exercises are commenced as this would provide optimum comfort and support. This improved, modified arrangement is included in the alternatively preferred embodiment of the invention shown in FIGS. 6–8 wherein like reference numerals represent like parts already described. In this alternative form of the invention, bladder 12 is affixed on a flat plate or carriage 70 adapted for longitudinal slidable movement relative to the table's top surface 16. A stud bolt 72 suitably fixed to plate 70 extends downwardly through a slot 74 in the top of the table with the slot extending axially along the central axis of the table a predetermined distance substantially as shown. The length or axial extent of slot 74 determines the range of slidable displacement of carriage 70 on table 14 in a manner believed apparent. The downwardly depending end of bolt 72 is threaded and engages a female threaded opening in the top of a cylindrical locking member 76 whose top surface 78 is adapted to rotatably and frictionally engage the bottom surface 80 on the underside of table 14 proximal to slot 74 when the locking member is rotated in a counterclockwise direction in relation to stud bolt 72 as viewed in FIG. 8. A lever arm 82 has one end suitably affixed to the sidewall of locking member 76, extends laterally through a longitudinal slot 84 provided in table sidewall 86, and terminates at its free end in a spherical handle 88 which facilitates manual movement of the lever arm back and forth through an angular range determined by the length or axial extent of slot 84. Thus, movement of lever arm 82 to the left, as viewed in FIG. 6 will, cause clockwise rotation of locking member 76 about stud bolt 72 thereby backing off the top surface of the locking member from its frictional engagement with the bottom surface 80 of the table and hence, freeing the carriage and therefore the bladder 12 thereon for selective slidable axial displacement axially on the table as determined by movement of the stud bolt 72 in slot 74 which latter serves as a guide means for such movement. When a suitable adjusted axial position of the carriage on the table is achieved, all that is necessary is to rotate the lever arm back to the right (FIG. 6) to thereby lock the carriage into its adjusted position by the action of locking member 76. It is apparent that the provision of the foregoing means enables each weightlifter using the present invention to easily and rapidly selectively adjust the carriage and inflatable bladder to a position on the table providing optimum comfort and support. The present invention thus is well suited for use in a gym or other exercising facility where many individuals work out using a single piece of equipment.

Figure 9:
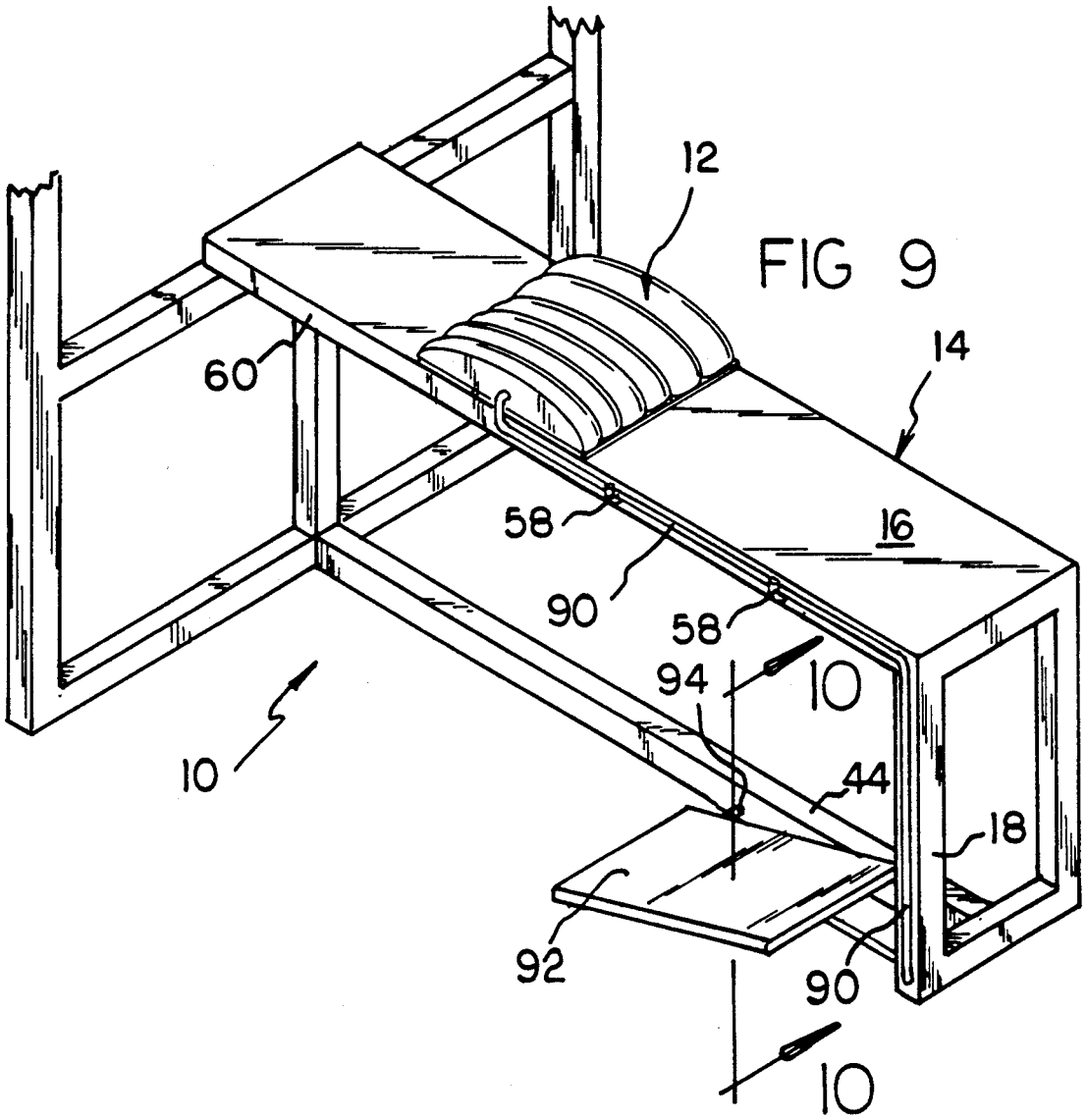
FIG. 9 is a perspective view in elevation of a third preferred embodiment of the invention.
Figure 10:
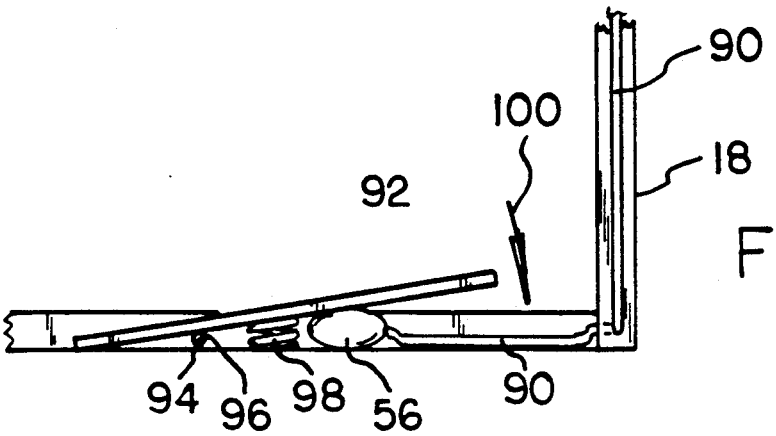
FIG. 10 is an end view of a portion of the embodiment of FIG. 9 taken along line 10—10 thereof.

Turning finally to FIGS. 9 and 10 there is shown yet a further modified, alternatively preferred form of the invention wherein foot treadle means are employed to pressurize inflatable bladder 12. Here again, like reference numerals represent like parts already described. In this form of the invention, a longer flexible pipe 90 extends along sidewall 60 where it is supported by a pair of spaced hooks 58, thence down the side of vertical leg 18, and finally backward a short distance on the floor under the table where flexible squeeze bulb 56 rests underneath foot treadle 92. The latter is suitably affixed to an axle rod 94 having one end suitably mounted for rotation in a hole 96 in axial cross bar 44. A helical spring 98 suitably attached to the underside of treadle 92 and bearing against the floor normally biases the treadle into a normal upward position where the undersurface of the treadle barely engages the squeeze bulb substantially as shown (FIG. 10). The treadle is positioned axially near the one end of the table so that when a lifter is in a supine position on the table, the lifter's leg and foot may comfortably reach and activate the treadle by pressing down on its upwardly facing surface. This action will cause the treadle to move in the direction of arrow 100 compressing the squeeze bulb and forcing more air into the interior of the bladder with the lifter all of the while remaining in the supine position. In this manner, the lifter will receive immediate feedback of the pressure increase against the muscles of the lumbar region and will be able to easily judge when optimum comfort and support have been achieved.

In practicing the present invention, the inflatable bladder 12, pipe 54, and squeeze bulb 56 preferably are fabricated of suitable flexible and durable material impervious to air such as rubber or polyvinyl plastic. The various sections of supporting structure for table 14 preferably are fabricated of metal and are attached together using known metal bracket and fastener assemblies.

It is apparent from the above that the present invention accomplishes all of the objectives set forth by providing a new and improved inflatable support adapted to provide adjustable pressurized support to the back and spinal regions of a weightlifter in the supine position, wherein the inflatable support advantageously is mounted on a carriage movable on a table or other horizontal surface, and wherein the inflatable support has pressurizing means adapted to be activated by a person in the supine position using his/her hand or foot.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. For example, an additional inflatable bladder 12 may be added to table 14 to provide support to the cervical spine region in addition to the lumbar region. Hence, the proper scope of the present invention should be determined only by the broadest interpretation of the appended claims so as encompass all such modifications and equivalents.

What is claimed as being new and desired to be protected by Letters Patent of the United States is as follows:

1. A new and improved support apparatus for use by a weightlifter comprising:

a surface adapted to support a weightlifter during weightlifting exercises, an inflatable bladder on said surface, and means for selectively pressurizing said inflatable bladder to provide a supporting cushion for an individual engaged in weightlifting exercises on said surface, wherein said means for selectively pressurizing includes manually activatable squeezable bulb means, and conduit means connecting said bulb means to said inflatable bladder, wherein said surface is a table and said table includes means for adjustably positioning said inflatable bladder on said table, wherein said means for adjustably positioning said inflatable bladder on said table includes a carriage adapted for slidable movement on said table, said inflatable bladder being mounted on said carriage, said carriage having guide means cooperating with said table, locking means coupled to said guide means, and selectively activatable means connected to said locking means, said selectively adjustable means extending laterally with respect to said table whereby said guide means may be locked in an adjusted position on said table by manual activation of said selectively activatable means by a user when the user is lying on said table surface, wherein said table further includes a longitudinally extending slot therein, said slot having an extent defining the range of adjustment of said carriage on said table, and said guide means is movable in said slot, and wherein said locking means coupled to said guide means includes means for engaging said table and locking said guide means in said slot in a selectively adjusted position, said means for engaging being operatively coupled to said selectively activatable means.

2. The apparatus of claim 1 further including foot treadle means engaging said squeezable bulb means.

3. The apparatus of claim 1 wherein said inflatable bladder has a cylindrically shaped top panel, and a series of spaced grooves in said top panel defining air passages therein.

4. The apparatus of claim 1 wherein said surface is on a table, said table having means for supporting a barbell at one end thereof.

* * * * *